US007614173B2

(12) United States Patent
Kim

(10) Patent No.: US 7,614,173 B2
(45) Date of Patent: Nov. 10, 2009

(54) ROAD TRAFFIC-CONTROL SIGNBOARD ASSEMBLY HAVING AUTOMATIC RETURN FUNCTION

(76) Inventor: Ki Ryong Kim, 214-301, Yongji Apt. 69 Yongho-dong, Changwon-si, Gyeongsangnam-do (KR) 641-041

( * ) Notice: Subject to any disclaimer, the term of this patent is extended or adjusted under 35 U.S.C. 154(b) by 87 days.

(21) Appl. No.: 11/989,801

(22) PCT Filed: Jul. 21, 2006

(86) PCT No.: PCT/KR2006/002872

§ 371 (c)(1),
(2), (4) Date: Jan. 31, 2008

(87) PCT Pub. No.: WO2007/015602

PCT Pub. Date: Feb. 8, 2007

(65) Prior Publication Data

US 2009/0090036 A1 Apr. 9, 2009

(30) Foreign Application Priority Data

Aug. 2, 2005 (KR) ..... 20-2005-0022608 U

(51) Int. Cl.
*G09F 7/00* (2006.01)

(52) U.S. Cl. ..... 40/612; 40/606.15; 40/602

(58) Field of Classification Search ..... 248/900; 404/10; 116/63 R, 63 P
See application file for complete search history.

(56) References Cited

U.S. PATENT DOCUMENTS 1,653,696 A * 12/1927 Clayton ..... 40/313
2,671,423 A * 3/1954 Mead ..... 116/28 R
3,616,557 A * 11/1971 Vara, Sr. ..... 40/613
4,884,317 A * 12/1989 Liu ..... 16/289
6,301,748 B1 * 10/2001 Su-Man ..... 16/342

FOREIGN PATENT DOCUMENTS

KR 1020050077151 A * 8/2005
WO PCT/KR2006/002872 2/2007

* cited by examiner

*Primary Examiner*—Lesley D Morris
*Assistant Examiner*—Kristina Staley
(74) *Attorney, Agent, or Firm*—Clement Cheng

(57) ABSTRACT

Provided is a road traffic-control signboard assembly with which a road traffic-control signboard can be assembled while being linked with a vertical support at right angle. The road traffic-control signboard assembly is fitted with and fixed to a road traffic-control signboard stay bar and has a structure of being returned to an original position even if impact by typhoon or collision of vehicles is applied to the road traffic-control signboard. Thus, the road traffic-control signboard assembly prevents a phenomenon that an initial fixed position of the road traffic-control signboard is changed because of impact by typhoon or collision of vehicles which is applied to the road traffic-control signboard, to thereby lose the function of the road traffic-control signboard.

3 Claims, 2 Drawing Sheets

ROAD TRAFFIC-CONTROL SIGNBOARD ASSEMBLY HAVING AUTOMATIC RETURN FUNCTION

This application is a national phase application of PCT/KR2006/002872, and claims priority from Korean application (KR) 20-2005-0022608 (Aug. 2, 2005) for inventor KIM, Ki Ryong.

TECHNICAL FIELD

The present invention relates to a road traffic-control signboard assembly, and more particularly, to a road traffic-control signboard assembly having an automatic returns function.

BACKGROUND ART

Road traffic-control signboards are essential elements in running of vehicles. Since road traffic-control signboards should be optimally recognized at drivers' visual fields, they are usually fixed at right angle to vertical supports which are built vertically at the margin of roads. For example, a conventional road traffic-control signboard assembly will be described below with reference to part of FIG. 1.

In the case of the conventional road traffic-control signboard assembly, a road traffic-control signboard 40 is simply fixed to the road traffic-control signboard stay bar 1 which is extended again over the road, using a U-bolt and nut. Therefore, assemblers' manpower can be reduced but the durability thereof is very poor. The following problems are caused. That is, as stated above, the conventional road traffic-control signboard assembly assembles the road traffic-control signboard 40 with the traffic signboard stay bar 1 using the U-bolt and nut. Thus, if strong force is applied to the conventional road traffic-control signboard assembly, because typhoon blows, an initial position of the road traffic-control signboard 40 is changed to thus make the front surface of the road traffic-control signboard 40 turn up to the sky or down to the road, or make it suspended at a slope. As a result, the road traffic-control signboard 40 loses its function and causes a failure in safety running of vehicles.

In the meantime, if impact is applied to the conventional road traffic-control signboard assembly, due to the excessively loaded freight in freight vehicles or the top portion of special-purpose motor vehicles such as cranes or heavy equipment, the obverse of the road traffic-control signboard 40 is slanted heading toward the road or is damaged. Finally, the same problems as those described above are caused. Hereupon, local government road facilities that receive accident or damage reports ride bucket vehicles and go to sites immediately, in order to straighten the road traffic-control signboard whose initial position has been changed again or replace it by a new one. For this reason, roads are blocked to thus delay a smooth road condition and cause a big economical loss and damage nationalistically. On the other hand, when typhoon blows or after typhoon passes a lot of road traffic-control signboards are out of position over the downtown whole area. In this case, big problems such as confusion, discomfort, and traffic jams are caused.

Moreover, repair works of long hours cause various kinds of big problems. Hereupon, to solve the above-described problems, this inventor filed a Utility-model application No. 20-2003-0040773 on Dec. 26, 2003 with the Korean Intellectual Property Office entitled "Horizontal support structure for making traffic-control signboards rotate" which has been registered as a Utility-model registration No. 20-0349900-0000 on Apr. 29, 2004. By the way, the above-described registered conventional art greatly changes the structure of the existing road traffic-control signboard stay bar 1. In principle, the existing road traffic-control signboard stay bar 1 does not cause any problem but is complicated in the structural viewpoint since a coil spring should be is mounted so as to be concentric with the road traffic-control signboard stay bar 1. As a result, in the case of the conventional art, it is not so easy to manufacture the road traffic-control signboard 40 and assemble it in the road traffic-control signboard stay bar 1 to thus cause the manufacturing cost to greatly rise up and the maintenance to be difficult and to additionally cause an unsafe problem since the weight of the road traffic-control signboard assembly is heavy.

DETAILED DESCRIPTION OF THE PREFERRED EMBODIMENT

To solve the above problems, it is an object of the present invention to provide a road traffic-control signboard assembly having a generally advanced automatic return function using structure of an existing road traffic-control signboard stay bar 1 as it is, which is preeminently improved in view of the function, economy, assembly, maintenance, weight, etc., in comparison with those of the conventional art. To accomplish the above object of the present invention, according to an aspect of the present invention, there is provided a road traffic-control signboard assembly comprising: a tubular elastic body having an insertion groove so as to be inserted into a road traffic-control signboard stay bar which is connected with a vertical support at right angle and a hole into which a rotation preventing screw can be inserted at right angle; a semicircular upper clamp which is assembled to enclose the tubular elastic body at the upper portion of the tubular elastic body, including a tightener having bolt holes through which a respective bolt is penetratively fixed for fixing a below-described lower clamp, in which the tightener is extended from the semicircular upper clamp, a hole into which a rotation preventive screw can be inserted at right angle, and a hasp which can hang a below-described tension spring on the upper portion of the semicircular upper clamp; a flat lower clamp which is hinged with the upper clamp, having bolt holes through which a respective bolt is penetratively fixed for fixing the upper clamp; a support plate which is assembled in a hinged manner with the lower clamp and the upper clamp, to support a road traffic-control signboard; a hinge pin which assembles the upper clamp, the lower clamp and the support plate all in a hinged manner; a reinforcement plate at the upper portion which a hanger for hanging the tension spring, in front of which the road traffic-control signboard is fixed, and with which the support plate is assembled with bolts and nuts; a tension spring which is assembled between the hasp of the upper clamp and the hanger of the reinforcement plate, which supports the road traffic-control signboard so as to return vertically even if the road traffic-control signboard moves; and bolts and nuts which rigidly tighten the upper clamp and the lower clamp. Preferably, a plate-shaped or rod-shaped stopper is additionally fixed on the upper portion of the upper clamp, so that the erect road traffic-control signboard is not inclined toward the upper clamp. Preferably, the material of the tubular elastic body is selected among rubber, sponge, and urethane.

BRIEF DESCRIPTION OF THE DRAWINGS

The above and other objects and advantages of the present invention will become more apparent by describing the preferred embodiments thereof in detail with reference to the accompanying drawings in which.

BEST MODE FOR CARRYING OUT THE INVENTION

Figure 1:
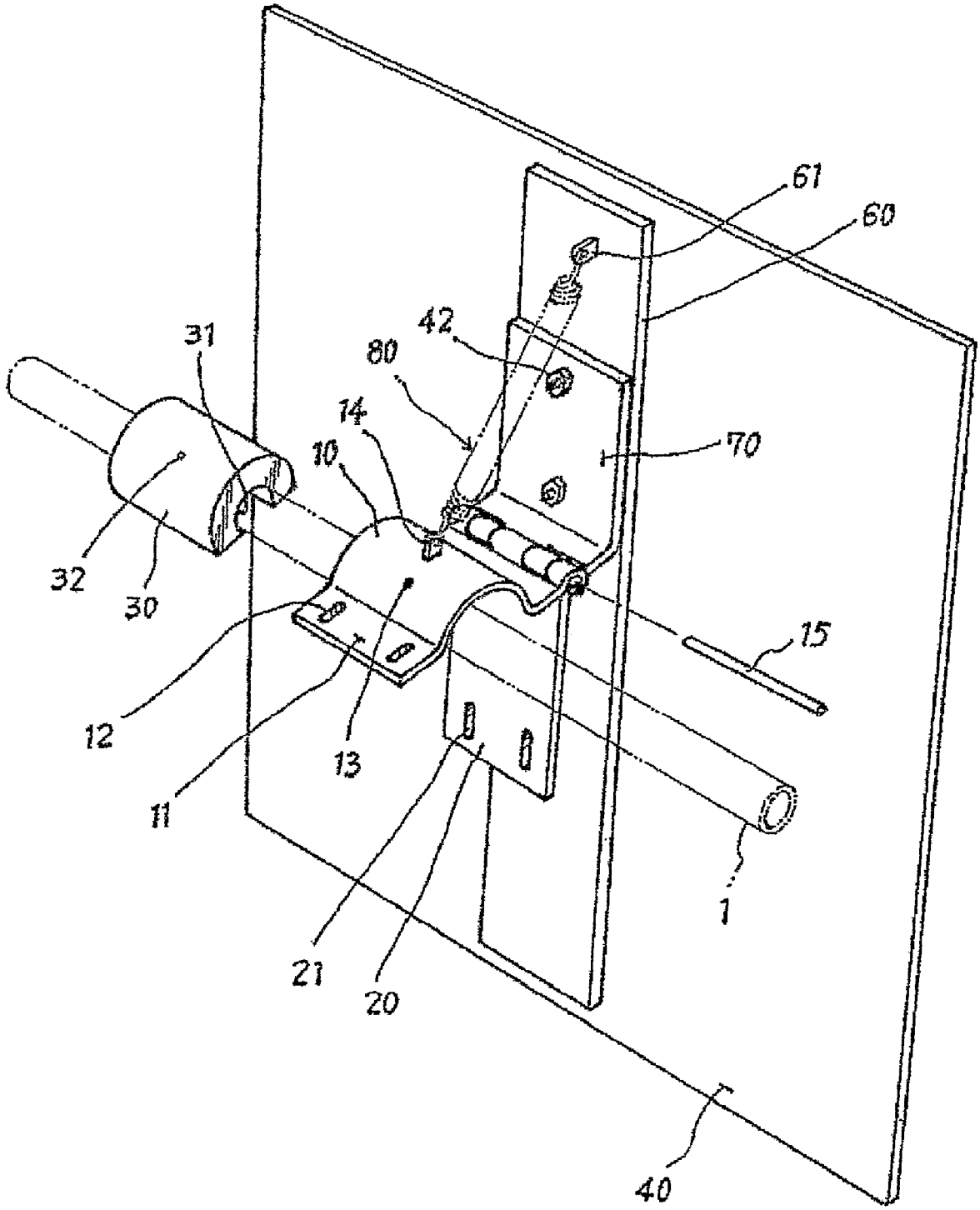
FIG. 1 is a perspective view showing the whole structure of a road traffic-control signboard assembly according to the present invention.

Herein below, a road traffic-control signboard assembly according to a preferred embodiment of the present invention will be described. The same reference numeral presented in the drawings show the same element.

First, the road traffic-control signboard assembly according to the present invention does not change structure of an existing road traffic-control signboard stay bar 1 but uses it as it is. In this point of view, the present invention differs greatly from the conventional art. The present invention has many inventive characteristics in which its structure is very simpler and its durability is more excellent than those of the conventional art.

Figure 2:
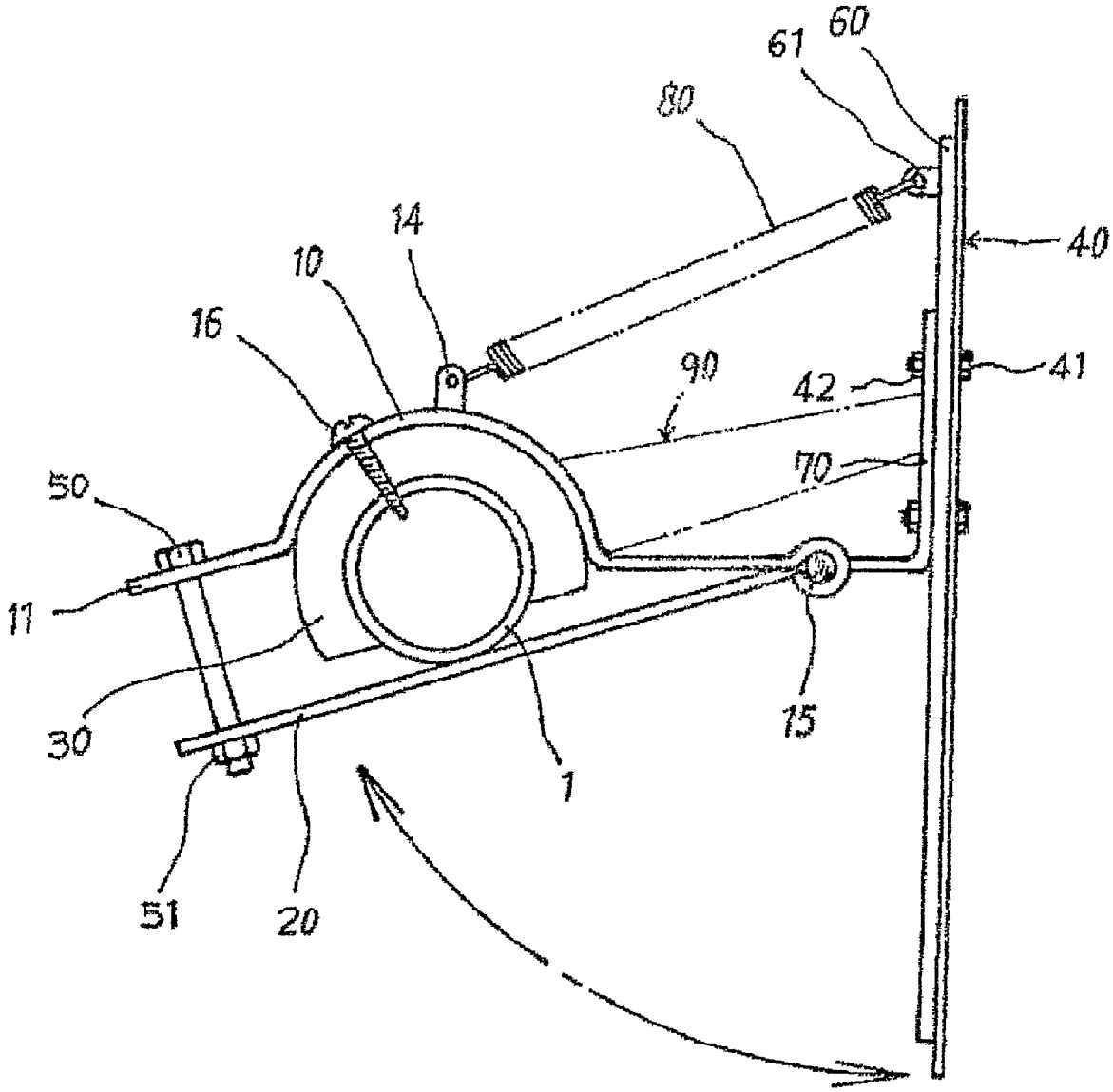
FIG. 2 is a sectional view showing a state of use of the road traffic-control signboard assembly according to the present invention.

That is, referring to FIGS. 1 and 2 in the present invention, a tubular elastic body 30 made of rubber, sponge, or urethane can be simply inserted into a proper position of a road traffic-control signboard stay bar 1 (hereinafter, referred to as a stay bar 1). As shown in FIGS. 1 and 2, an insertion groove 31 that can be inserted into the outer surface of the stay bar 1. The lower portion of the tubular elastic body 30 is opened and thus the insertion groove 31 can be extended by hands seizing the tubular elastic body 30. Then, the tubular elastic body 30 can be simply inserted into the stay bar 1. Finally, the tubular elastic body 30 is closely fixed to the stay bar 1 as shown in FIG. 2. In the meantime, the tubular elastic body 30 is preferably fabricated in various forms in size, according to change in diameter of the stay bar 1, but since the tubular elastic body 30 has an elasticity naturally, there is no reason to produce the tubular elastic body 30 in various sizes certainly because there is no problem to use it even if diameter of the stay bar 1 is a little big or small. Further, since the standard and diameter of the stay bar 1 are substantially the same, only one basic type of the tubular elastic body 30 can be used without causing any problems.

As described above, after the tubular elastic body 30 is inserted into the stay bar 1, a hole is formed on the stay bar 11 through a hole 32 using a hand drill. The diameter of the hole does not cause any hindrance in intensity of the stay bar 1. In this case, if the end portion of a rotation preventive screw 16 may be inserted into the hole, the diameter of the hole can be acceptable. Here, the tubular elastic body 30 can be assembled with the stay bar 1 after a hole has been formed on the stay bar 1.

Next, after a semicircle upper clamp 10 is positioned at the upper portion of the tubular elastic body 30, the rotation preventive screw 16 is assembled through the hole 32 of the tubular elastic body 30 and a hole 13 of the upper clamp 10. Accordingly, as shown in FIG. 2, the tubular elastic body 30 and the upper clamp 10 can be kept in their positions on the stay bar 1.

Then, a flat lower clamp 20 which is assembled with the upper clamp 10 by a hinge pin 15 in a hinged manner, is made to contact the bottom of the stay bar 1 and to be fixed to the stay bar 1 using bolts 50 and nuts 51, as shown in FIG. 2.

Then, a support plate 70 is assembled in a hinged way with the upper clamp 10 and the lower clamp 20 by the hinge pin 15. Then, a reinforcement plate 60 to which a road traffic-control signboard 40 is fixed, is located in front of the support plate 60, and is assembled by bolts 41 and nuts 42. That is, the support plate 70, the reinforcement plate 60 and the road traffic-control signboard 40 are integrally formed.

As shown in FIGS. 1 and 2, a tension spring 80 is hung between a hasp 14 of the upper clamp 10 and a hanger 61 of the reinforcement plate 60, and assembled. As shown in FIG. 2, a plate-shaped or rod-shaped stopper 90 is additionally fixed on the upper portion of the upper clamp 10, so that the erect road traffic-control signboard 40 is not inclined toward the upper clamp 10.

As described above, the rotation preventive screw 16 can be replaced by an ordinary pin, bolt, or annular rod. Here, when the tubular elastic body 30 and the upper clamp 10 are assembled with the stay bar 1 after the annular rod is soldered and fixed to the stay bar 1 beforehand, the annular rod can pass through and protrude from the respective holes 32 and 13. However, in this case, it is naturally expected that it will be difficult to work. Also, the tubular elastic body 30 of the present invention is cut at its lower portion thereof, and thus the insertion groove 31 is opened. Accordingly, the lower clamp 20 contacts justly the bottom of the stay bar 1, and thus the road traffic-control signboard 40 can be turned by as a big angle as an arrow trajectory of FIG. 2. As a result, in the case that impact due to collision of a freight vehicle is applied to the lower portion of the road traffic-control signboard 40, the road traffic-control signboard 40 is smoothly escaped from the impact lest the central portion of the road traffic-control signboard 40 should not be damaged. As being the case, a perfectly pipe-shaped tubular elastic body can be used. In the meantime, as described above, any commercial changes belong to the technical scope of the present invention.

It is natural that two sets of road traffic-control signboard assemblies according to the present invention be used for one road traffic-control signboard. If the road traffic-control signboard becomes large in size, it is natural that several road traffic-control signboard assemblies be assembled with one stay bar in use.

As described above, the road traffic-control signboard assembly according to the present invention is used in the state of FIG. 2. Even if wind force or other impact is applied in front of the road traffic-control signboard 40 in the FIG. 2 state, the road traffic-control signboard 40 is pushed to the left-side direction of the arrow and is turned over within various angle ranges. Thereafter, if the wind force that is, birr or other impact disappeared, the road traffic-control signboard 40 returns to the original position by the pulling force of the tension spring 80. Here, a reason why the road traffic-control signboard 40 has been pushed backward by the birr or impact which has been applied to the road traffic-control signboard 40 is because the stopper 90 is fixed to the upper clamp 10, and thus the upper portion of the road traffic-control signboard 40 is not pushed backward based on the hinge pin 15.

In the meantime, even in the case that strong wind blows from the left side of the road traffic-control signboard 40 to the right side thereof, in the FIG. 2 state, the road traffic-control signboard 40 is not turned to the left side of the road traffic-control signboard 40 but is turned only to the right side thereof. This is also because the road traffic-control signboard 40 cannot be turned toward the upper clamp 10 by the stopper 90. Here, a coil spring is assembled with the hinge pin 1, to thus keep the road traffic-control signboard 40 in its position. However, it is not always necessary to assemble the coil spring with the hinge pin 1.

As described above, the present invention provides a road traffic-control signboard assembly having an automatic return function even if impact is applied to a road traffic-control signboard. The conventional art changes the structure of the stay bar 1, but the present invention does not change the existing stay bar 1 in use. This feature of using the existing stay bar without changing the structure of the stay bar is inventive in itself. Further, the road traffic-control signboard assembly can be simply assembled with and disassembled from the stay bar 1, and the structure of the road traffic-control signboard assembly is very simple. Accordingly, it is easy to fabricate the road traffic-control signboard assembly. Moreover, the present invention is more excellent in its maintenance, more inexpensive in its manufacturing unit cost, and lighter in its weight to thus enable a very easy installation and maintenance work, than those of the conventional art. As a result, the present invention has an economic efficiency having preeminently improved characteristics.

Further, a semi-permanent use is possible since the present invention has an excellent durability from the structural characteristic and the frequent breakdown has hardly occurred. In particular, the tubular elastic body 30 does not need to be fabricated according to diameter of the stay bar 1, even if the diameter of the stay bar 1 alters a little, and the road traffic-control signboard assembly according to the present invention can be flexibly used, to thereby provide an effect of doing a big contribution in enhancing the whole economic efficiency, convenience, workability.

As described above, the present invention has been described with respect to particularly preferred embodiments. However, the present invention is not limited to the above embodiments, and it is possible for one who has an ordinary skill in the art to make various modifications and variations, without departing off the spirit of the present invention. Thus, the protective scope of the present invention is not defined within the detailed description thereof but is defined by the claims to be described later and the technical spirit of the present invention.

INDUSTRIAL APPLICABILITY

As described above, the present invention provides a road traffic-control signboard assembly which can be used for a traffic-control signboard.

The invention claimed is:

1. A road traffic-control signboard assembly comprising: a tubular elastic body having an insertion groove so as to be inserted into a road traffic-control signboard stay bar which is connected with a vertical support at right angle and a hole into which a rotation preventing screw can be inserted at right angle; a semicircular upper clamp which is assembled to enclose the tubular elastic body at an upper portion of the tubular elastic body, including a tightener having bolt holes through which a respective bolt is penetratively fixed for fixing a lower clamp, in which the tightener is extended from the semicircular upper clamp, a hole into which a rotation preventive screw can be inserted at right angle, and a hasp which can hang a tension spring on the upper portion of the semicircular upper clamp; a flat lower clamp which is hinged with the upper clamp, having bolt holes through which a respective bolt is penetratively fixed for fixing the upper clamp; a support plate which is assembled in a hinged manner with the lower clamp and the upper clamp, to support a road traffic-control signboard; a hinge pin which assembles the upper clamp, the lower clamp and the support plate all in a hinged manner; a reinforcement plate at the upper portion which a hanger for hanging the tension spring, in front of which the road traffic-control signboard is fixed, and with which the support plate is assembled with bolts and nuts; a tension spring which is assembled between the hasp of the upper clamp and the hanger of the reinforcement plate, which supports the road traffic-control signboard so as to return vertically even if the road traffic-control signboard moves; and bolts and nuts which rigidly tighten the upper clamp and the lower clamp.

2. The road traffic-control signboard assembly according to claim 1, wherein a plate-shaped or rod-shaped stopper is additionally fixed on the upper portion of the upper clamp, so that the erect road traffic-control signboard is not inclined toward the upper clamp.

3. The road traffic-control signboard assembly according to claim 1, wherein the material of the tubular elastic body is selected among rubber, sponge, and urethane.

* * * * *